United States Patent [19]

Baas et al.

[11] Patent Number: 4,524,954

[45] Date of Patent: Jun. 25, 1985

[54] METHOD OF OPERATING A MIXER TYPE HOT METAL CAR FOR THE TRANSPORT OF MOLTEN IRON AND A DEVICE FOR CARRYING OUT THE METHOD

[75] Inventors: Willem Baas; Tette Hof, both of Heemskerk, Netherlands; Heinrich Comes, Borken, Fed. Rep. of Germany; Helmut Jaunich, Raesfeld, Fed. Rep. of Germany; Hubert Krampe, Reken, Fed. Rep. of Germany

[73] Assignees: Hoogovens Groep B.V., IJmuiden, Netherlands; Foseco Trading A.G., Chur, Switzerland

[21] Appl. No.: 461,389

[22] Filed: Jan. 27, 1983

[30] Foreign Application Priority Data

Feb. 4, 1982 [NL] Netherlands ..... 8200418

[51] Int. Cl.[3] ..... F27D 3/00

[52] U.S. Cl. ..... 266/45; 266/165; 266/272; 266/287; 75/46

[58] Field of Search ..... 266/165, 44, 276, 45, 266/271, 272, 287, 248, 240; 75/46

[56] References Cited

U.S. PATENT DOCUMENTS

| | | | |
|---|---|---|---|
| 2,177,716 | 10/1939 | Heuer | 266/165 |
| 3,661,374 | 5/1972 | Van Wierst | 266/165 |
| 4,010,936 | 3/1977 | Takashima | 266/45 |
| 4,381,855 | 5/1983 | Ryan | 266/287 |
| 4,390,170 | 6/1983 | Schaefer et al. | 266/165 |
| 4,424,956 | 1/1984 | Grant et al. | 266/287 |
| 4,424,957 | 1/1984 | Grant et al. | 266/287 |

*Primary Examiner*—Melvyn J. Andrews
*Assistant Examiner*—S. Kastler
*Attorney, Agent, or Firm*—Stevens, Davis Miller & Mosher

[57] ABSTRACT

A hot metal car is used for the transport of molten pig iron from a blast furnace to a steel making plant, the car having an opening through which it is filled and emptied. To restrict heat loss from the car, the opening is closed during at least one of (a) the journey from the blast furnace station to the steel making plant and (b) the journey from the steel making plant back to the blast furnace by a disposable cover which is at least partly lost into the molten iron during the course of the emptying or filling of the car at the end of the journey concerned.

6 Claims, 20 Drawing Figures

METHOD OF OPERATING A MIXER TYPE HOT METAL CAR FOR THE TRANSPORT OF MOLTEN IRON AND A DEVICE FOR CARRYING OUT THE METHOD

BACKGROUND OF THE INVENTION

1. Field of the Invention

The invention relates to a method of operating a mixer type hot metal car for the transport of molten iron, particularly in conveying pig iron from a blast furnace to a steel making plant, and to a device for carrying out this method.

2. Description of the Prior Art

In the steel industry, pig iron manufactured in a blast furnace is usually conveyed in the liquid state to a steel making plant by means of transport vessel known as a mixer type hot metal car. Another name used for this vehicle is a torpedo car. This hot metal car is a rail vehicle having a torpedo-shaped transfer vessel which is lined on its inside with refractory bricks and is supported on a bogie at each end. The transfer vessel is provided with an opening, known as the pouring mouth, which during filling with pig iron and while the transfer vessel is being conveyed is located at the top of the transfer vessel. The transfer vessel is rotated about its longitudinal axis to empty the vessel, so that the pig iron is discharged through the opening into a receiver. An example of such a car is given in Netherlands patent application No. 68.14343 (U.S. Pat. No. 3,661,374).

In practice, the transfer vessel is filled at a blast furnace with molten pig iron at about 1500° C., and is then conveyed to a steel making plant. The pig iron is transferred from the vessel into a receiver in the steel making plant and the empty vessel is returned to a blast furnace to be refilled with pig iron.

Sometimes an intermediate stop is made on the outward journey with the full vessel, during which the pig iron in the vessel subjected to treatment, typically being desulphurised. For this purpose a lance is inserted into the vessel through the opening.

In a steel works a number of such cars are simultaneously in operation. The cycle time of a car is an average of 15 hours, comprising 3 hours for filling, 6 hours for the outward journey and 6 hours for return of the empty vessel. In practice these average times regularly show considerable variations because stops are made for various reasons during the outward and return journey. An example of a stop made on the return journey is when a car is temporarily put out of operation.

One problem with the known method is that heat loss occurs whilst the car is in operation. Some of this heat loss is the result of radiation and convection from the outside surface of the vessel; more heat loss is due mainly to heat radiation through the opening from the inside of the vessel to the atmosphere. Heat loss during the outward journey means that the pig iron is supplied to the steel making plant at a lower temperature than that at which it is filled into the vessel. If there is and extremely long stop, this may mean that the pig iron can no longer be processed in the steel making plant. Because of heat loss during the return journey, the refractory brick in the empty vessel cools down. This also leads to a lower temperature of the pig iron when supplied to the steel making plant, since the pig iron, when charged into the vessel at the blast furnace, loses heat to the brick. Also, if the brick cools down considerably as a result of a long return journey, cracks may then occur in the brick thereby reducing the life of the brick.

SUMMARY OF THE INVENTION

The object of the invention is to provide a method of operating a mixer type hot metal car for molten iron in which the heat loss through the opening of the transfer vessel is reduced.

A further object of the invention is to provide low cost, simple and safe device for reducing the heat loss through the opening of the transfer vessel for molten iron.

According to the invention, a disposable cover is fitted to seal the opening of the vessel, after it is filled and/or after discharge of the iron from the vessel in order to reduce the heat loss from the vessel through the opening, and the cover is allowed to be carried away with the iron at the end of the subsequent journey when the pig iron is discharged from the vessel or the vessel is filled with a further charge respectively, so that the cover is at least partly lost into the iron.

Preferably a disposable cover is employed in this manner in each of the journey from the filling location to the discharge station and the journey from the discharge station to the next filling station.

One advantage of the method according to the invention is that greater use of scrap is possible in the steel making plant as a result of the higher temperature at which the pig iron is supplied to the plant, thereby providing a crude steel cost price advantage.

Another advantage arises when the method is employed during the return of an empty transfer vessel. Due to the improved heat retention of the refractory brick in the transfer vessel savings can be achieved in the costs of additional heating of the brick because the number of occasions when the brick temperature is too low is reduced. Moreover, a longer brick life is achieved by greater heat retention because no cracks are formed. Moreover, cheaper types of refractory material may be used for the brickwork in the vessel.

Because a disposable cover is used in the method according to the invention, the above advantages may be obtained with only one extra operating step, namely fitting a cover at the beginning of the outward and/or return journey. The method according to the invention is also safe because the cover need not be removed at the end of the journey.

If the pig iron is desulphurised in the transfer vessel, the lance used for this should preferably be inserted into the vessel through a hole in the cover in the region of the opening in the vessel. This hole is preferably made in the cover by perforating the cover by means of the lance when introducing it into the vessel. Preferably also, before such a treatment of the pig iron, at least one further hole is made in the cover in the region of the opening in the vessel to allow the gases formed during the treatment to escape. A further advantage of the method, during desulphurisation, is that the mixer can be filled to a greater degree than if no cover is used. Without the use of a cover, the degree of filling is limited because of the danger of splashing during desulphurisation. Because of the higher permitted degree of filling the transfer vessel costs per tonne of pig iron can be reduced.

When a cover is used on the empty transfer vessel according to the invention, the hole in the cover for subsequently filling the transfer vessel with pig iron is preferably made by pouring the pig iron onto the cover when starting to fill the vessel.

A device for carrying out the method of the invention comprises a disposable cover for closing the opening of the vessel and means for retaining the cover on the vessel. The retaining means should be effective to hold the cover in place under all anticipated conditions, such as wind strength.

The cover should meet requirements for resistance to the radiation from the inside of the transfer vessel and for the desired insulation value.

The retaining means are all the more essential if the cover is light because of its disposable character. In one preferred embodiment the retaining means consist of part of the cover which extends into the opening, at least over a certain distance, and is located close to the edge of the opening. The part projecting into the opening should preferably be a wall structure which is closed circumferentially. In order to protect the refractory lining at the opening during filling of the vessel, at least temporarily. The part extending into the opening has preferably a tapered outer surface, so that when placed on the vessel the cover tends to wedge in the opening and this tapering part is preferably resiliently deformable so that it is adapted to the shape of the opening when fitted.

In one preferred embodiment of the cover, in which a hole can be made for filling the vessel with pig iron, the cover, at least locally in the area of the vessel opening, is made so that it collapses (loses structural integrity) under the influence of liquid pig iron, forming a hole. To this end, the cover preferably has a cup-shaped part or depression extending into the opening, the bottom of which collapses into the hole formed when the liquid pig iron is poured into the depression. The hole is formed by the impulse of the pig iron jet, which falls into the vessel during tapping of a blast furnace via a pig iron runner, and/or by the influence of the high temperature of the pig iron on the material from which the cover is made. The cover is preferably shaped so that vertical side wall of the cup consists of at least part of the height of the above-mentioned circumferentially closed wall structure.

For desulphurisation purposes the cover is preferably provided with at least one prefabricated weak point in the region of the opening, which can be mechanically perforated e.g. by pushing with a pointed body.

In an embodiment wich is preferred under certain conditions, the cover has a collar extending outside the area of the opening. This collar at least partially protects the refractory lining on the outside of the opening when the transfer vessel is being filled with pig iron.

In selection of the material of the disposable cover, consideration must be given to the desideratum that the cover should not give rise to any undesirable additives in the pig iron and/or slag when it is lost into the vessel on filling or into the receiver on discharge.

A preferred cover is manufactured at least partly from a material comprising at least 50% refractory filler material, 5–40% refractory fibrous material and 2–10% binding agent.

It is worth mentioning that a mat of refractory fibres and binder has been proposed for use in contact with the surface of a molten metal bath to reduce heat loss, see e.g. U.S. Pat. No. 3,876,420, but there has apparently been no suggestion of the use of a disposable cover for the filling opening of a transport vessel.

A hot metal car should be located carefully under the end of a pig iron runner before the vessel is filled with pig iron. In the case of a mixer without a cover, this positioning is usually achieved by use of the opening which is visible in sharp contrast due to the high temperature of the inside of the transfer vessel. If a cover is used, this method of positioning cannot be used; therefore the cover should preferably, have on the side facing away from the inside of the vessel, a contrasting mark which provides an unambiguous indication of the position and extent of the opening in the vessel when the cover is fitted to close this opening.

BRIEF DESCRIPTION OF THE DRAWINGS

Preferred embodiments of the invention will be illustrated below by way of non-limitative example with reference to the accompanying drawings, in which.

DESCRIPTION OF THE PREFERRED EMBODIMENTS

Figure 1A:
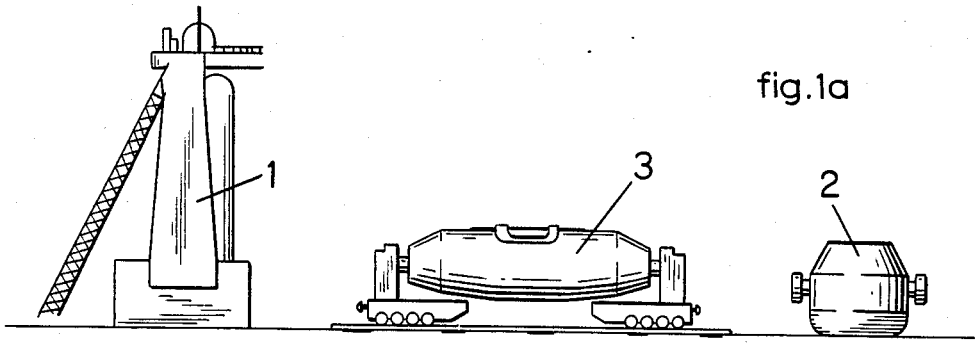
FIGS. 1*a* to 1*d* are a diagrammatic representation of the method according to the invention.

In FIG. 1*a* the conveyance of liquid pig iron between a blast furnace 1 and a steel making plant 2 by means of a mixer type hot metal car 3 (torpedo car) is represented symbolically.

Figure 1B:
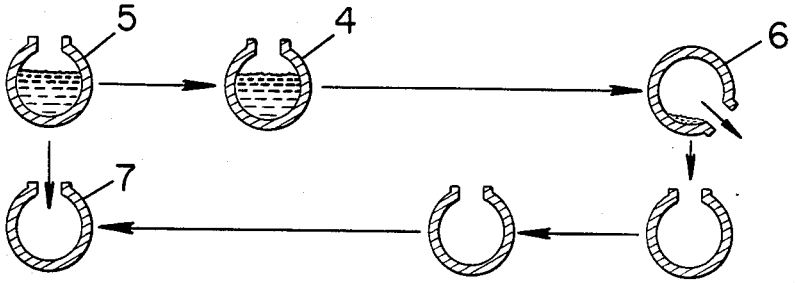

FIG. 1*b* show diagrammatically the method of conveyance according to the state of the art, in which the hot metal car 4 is shown in cross-section. The car is moved, after being filled with pig iron at the blast furnace (5) to the steel making plant where the pig iron is transferred to a receiver, not shown by rotating the vessel (6). The empty car is then returned to the blast furnace and filled again with pig iron (7).

Figure 1C:
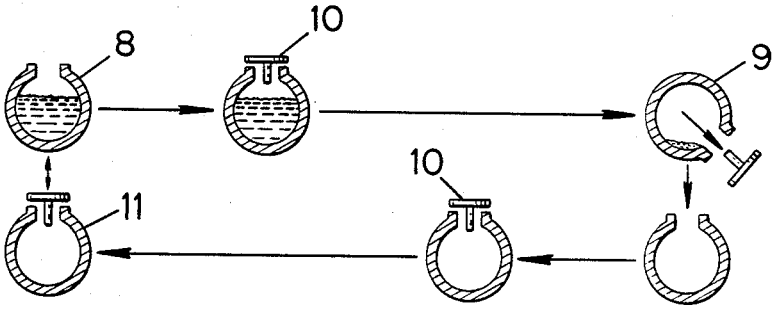

As shown in FIG. 1*c*, according to the method of the invention, a disposable cover 10 is fitted on the vessel to close the opening thereof after the vessel is filled with pig iron (8) and/or after the pig iron has been transferred to the receiver (9). In each case a cover is lost into the pig iron, at 9 when the vessel is discharged and at 11 when the vessel is recharged.

Figure 1D:
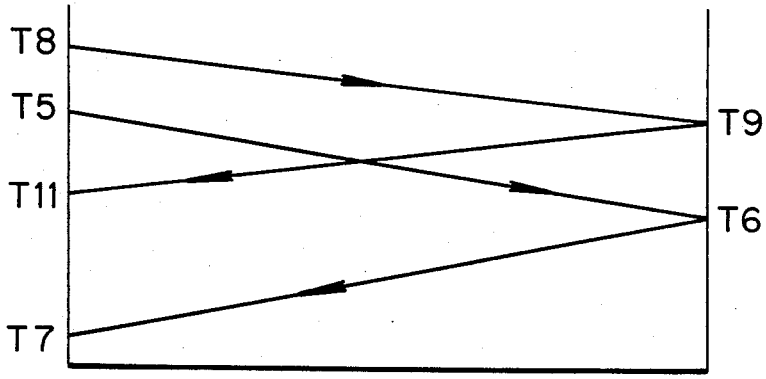

FIG. 1*d* shows diagrammatically the variation of the temperature of the pig iron and of the refractory brick of the vessel of the hot metal car during outward journeys 5-6, 8-9, and during return journeys 6-7, 9-11. The location at the blast furnace is at the left, and the location at the steel making plant at the right. Temperature is plotted vertically. The lines 8-9-11 apply for the case where a disposable cover is fitted on the mixer car both during the outward and return journeys and the lines 5-6-7 for the case where no cover is used during both the outward and return journeys 5-6-7. It is thus shown that, when a cover is used, the temperature loss both during the outward journey 8-9 and during the return journey 9-11 is smaller than during the outward journey 5-6 and return journey 6-7 without a cover. Temperature T9, at which the pig iron is supplied to the steel works when using the cover, is higher than temperature T6 when no cover is used. Temperature T7 of the refractory lining, just before filling, when no cover is used, is lower than temperature T11 when the cover is used.

Figure 2A:
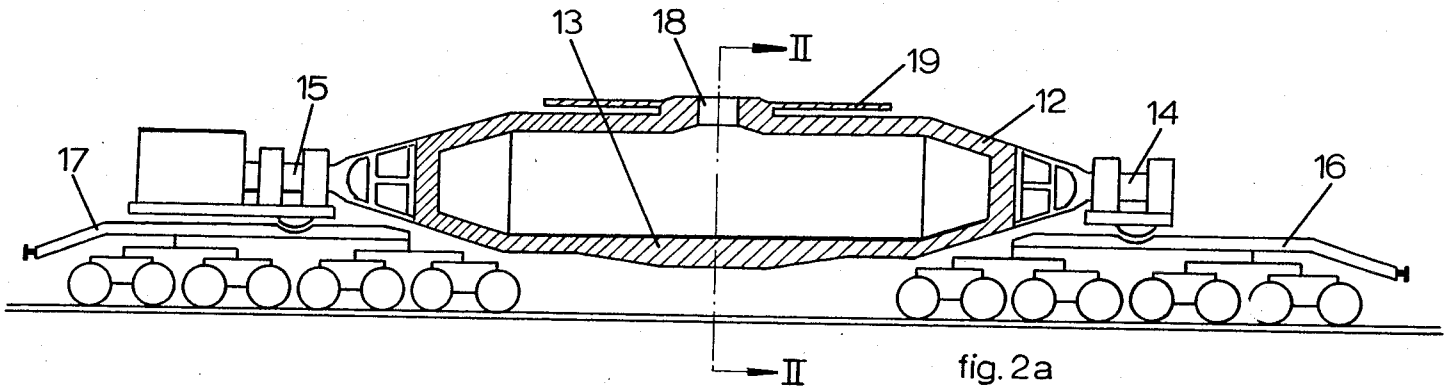
FIGS. 2*a* and 2*b* show a longitudinal and transverse section respectively through a typical mixer type hot metal car.
Figure 2B:
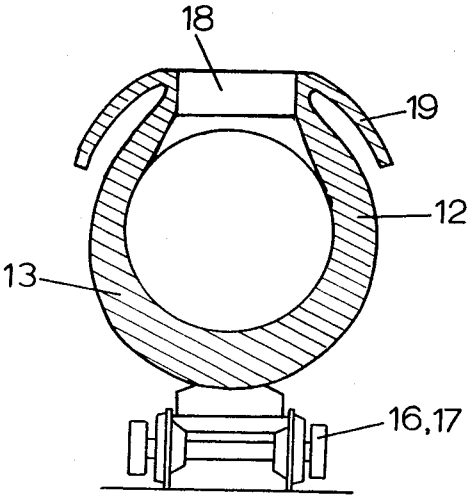

FIGS. 2*a* and 2*b* show a mixer type hot metal car in a conventional embodiment comprising a torpedo-shaped transfer vessel 12, which is provided on the inside with a refractory brick 13, and which may be rotated about the horizontal longitudinal axis at both ends 14 and 15, and is supported on bogies 16 and 17. The vessel has an opening 18, around which it is protected by a plate 19 on the outside against the pig iron being poured into the vessel. This plate 19 is in most cases right up against the opening.

In the preferred method of the invention a disposable cover is fitted for closing the opening, and retaining means are used to keep the cover located at the opening, particularly during movement of the car. This movement usually takes place in the open air, and the cover, which should preferably be lightweight, may easily be lifted by wind from the car if no retaining means are used. However the use of the retaining means should preferably not involve any additional operations when removing any remains of the disposable cover after filling or discharge, and when fitting a new disposable cover after filling or discharge.

Figure 3D:
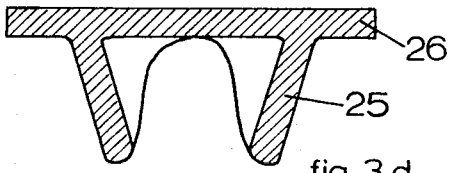
FIGS. 3*a* to 3*h* show various forms of disposable cover for use in the method according to the invention, in section.
Figure 3E:
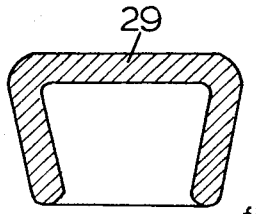
Figure 3F:
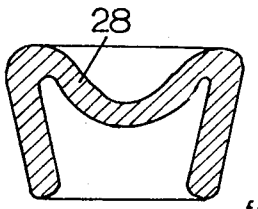
Figure 3A:
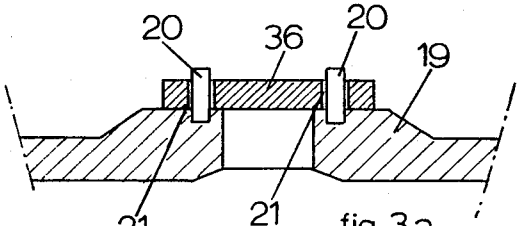
Figure 3B:
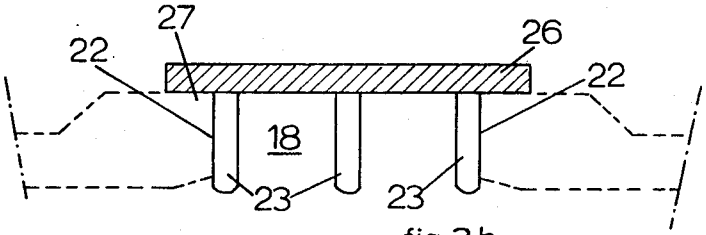
Figure 3C:
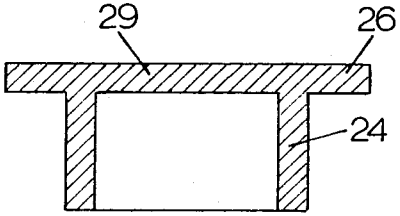

In the embodiment shown in FIG. 3*a*, the retaining means consist of pins 20 which are connected to plate 19 and which extend into holes 21 in the flat disposable cover 36. Pins connected to the disposable cover, which drop into holes in the plate, may alternatively be provided. In each of the embodiments of the disposable cover shown in FIGS. 3*b* to 3*h* the retaining means consist of a part or parts of the cover projecting into the opening and located close to or abutting the edge wall 22 of the opening. In the cover of FIG. 3*b*, this inwardly projecting part is in the form of a plurality of rod-shaped elements 23. In the cover shown in FIG. 3*c*, the part projecting into the opening is a wall structure 24 which is closed circumferentially and which at least partially protects the refractory lining of the opening of the transfer vessel while it is being filled with pig iron.

In the covers shown in FIGS. 3*d* to 3*h* the part extending into the opening has an external taper (tapering towards the inside of the vessel when fitted) dimensioned so that the cover fits into the opening when located on the vessel. Whether or not combined with elastic deformability of the tapered section, this feature causes the cover to wedge in the opening when located on the vessel, and also provides the opening with the excellent sealing against heat loss to convection. FIG. 3*d* shows an embodiment of the tapered configuration with separate legs 25.

In FIGS. 3*a* to 3*d* inclusive, the cover is shown provided with an external collar 26 extending past the edge of the opening 18, which collar at least temporarily protects the refractory lining 27 outside of the opening during the filling with pig iron.

Figure 3G:
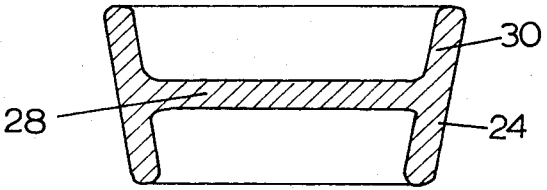
Figure 3H:
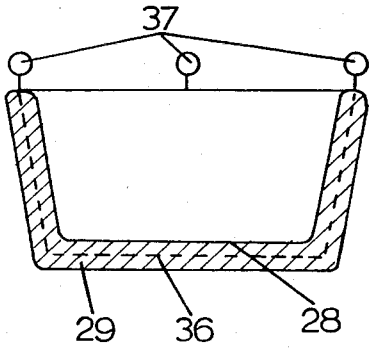

In the embodiments of FIGS. 3*f* to 3*h* the upper portion 29 of the cover which closes the opening 18 has a cup-shaped section 28 or depression which reduces the splashing of pig iron when commencing filling. In the covers of FIGS. 3*g* and 3*h*, the vertical side wall 30 of this cup portion coincides with the tapered circumferentially closed wall structure 24.

The material from which the cover is manufactured must meet essentially contradictory requirements. On the one hand the cover should have a good insulation value to limit heat transmission through it. The cover should also be at least sufficiently refractory to resist the thermal loading from the liquid pig iron or the refractory brick during the outward or return journey. On the other hand, the part or parts of the cover which are carried away with the pig iron when the car is filled, or when the car is emptied into the receiver, should arrive in a pig iron bath in disintegrated form so that they will not remain as distinguishable lumps of the cover. At the same time, the cover should not give rise to undesirable additives in the pig iron and/or slag during disintegration e.g. by combustion, melting, decomposition or loss of cohesion.

As shown in FIG. 3*h*, the cover can be reinforced with stiffener 36, e.g. a gauze to obtain a low weight, good elasticity and sufficient strength. Eyes (lugs) 37 or the like can be connected to it for use when handling the cover. However, these eyes or lugs may be anchored in the cover material even when no stiffener or reinforcement is used.

In a further embodiment of the invention the cover is divided into several parts, in which case part of the cover, e.g. collar 26 and or the circumferentially closed wall structure 24 is retained when the mixer is filled and can be re-used.

A hole is made in the wall portion 28 which closes opening 18 for the purpose of filling the vessel, preferably by the effect of the pig iron on the cover when filling starts. This hole comprises at least part of the wall portion 28. This effect of the pig iron is the mechanical action of the impulse of the jet of pig iron from the blast furnace runner, which breaks a hole through or the thermal action of the heat of the liquid pig iron on the material of the cover which burns or melts a hole or by a combination of both these effects.

Figure 4B:
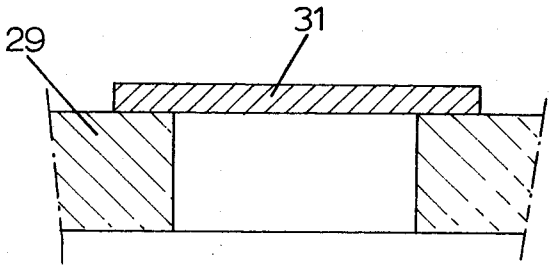
FIGS. 4*a* to 4*c* show further details of various covers for use in the invention.
Figure 4C:
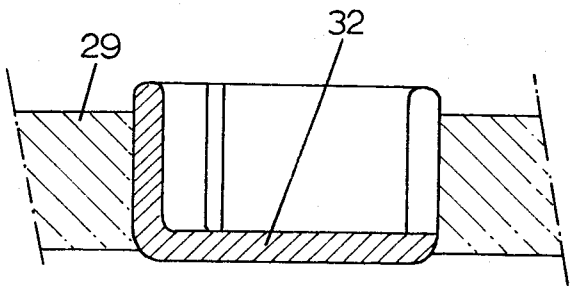
Figure 4A:
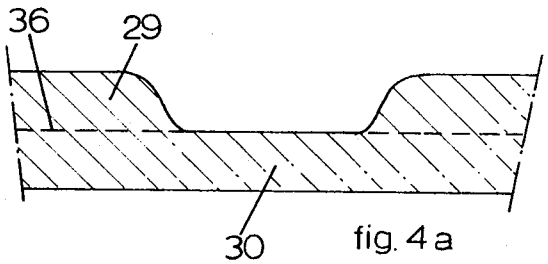

The cover of FIGS. 4*a* to 4*c* has for this purpose an at least local weakening. In the embodiment shown in FIG. 4*a*, this consists of a wall thinning 30, in FIG. 4*b* it is a shear plate 31, and in FIG. 4*c* it consists of a cap 32. The embodiments of FIGS. 4*b* and 4*c* are well suited for the making of a hole by pushing with a pointed body. This happens when the pig iron is subjected to desulphurisation treatment in the vessel on the outward journey. The hole is thus made with the lance when the lance is being inserted in the mixer. To enable gases formed during the treatment to escape, the hole can be made larger than is required for pushing through the lance. However, it should not be so large that the pig iron is splashed outwards to an impermissible degree during the treatment. One or more further holes can also be made in wall portion 29 for the escape of gases. The method of making a hole by pushing with a pointed body may also be used for filling the mixer car.

Covers of different designs may be used for the outward and return journey, respectively, e.g. depending on whether or not weak points 30,31,32 are provided, and on whether or not a collar 26 is provided. The covers for the outward and/or return journey may also vary in design according to the expected duration of these journeys.

EXAMPLE

Figure 5B:
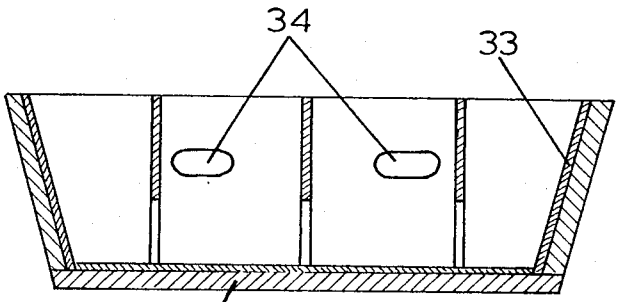
FIGS. 5*a* to 5*c* are a top view and sectional views of one embodiment of the disposable cover.
Figure 5C:
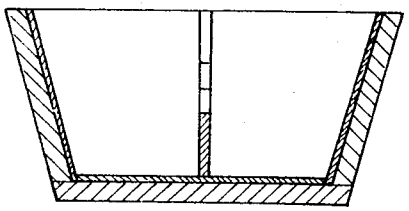
Figure 5A:
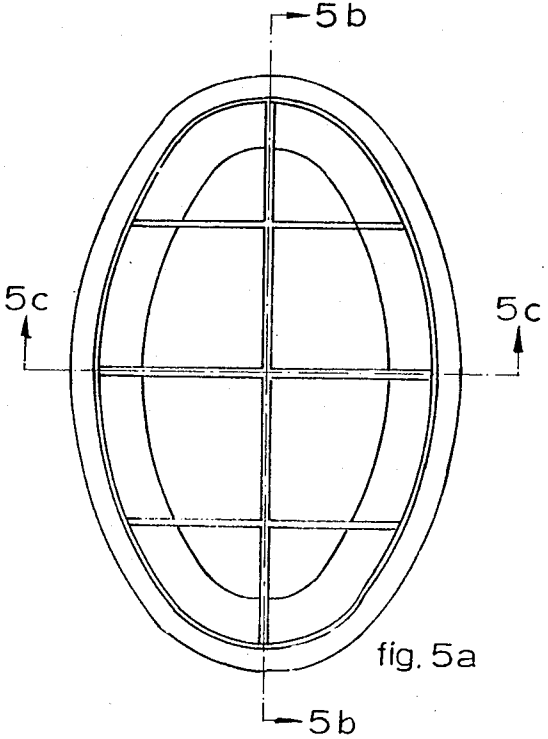

A number of covers, each as shown in FIGS. 5*a* to 5*c* inclusive, were manufactured for sealing the opening of a 450 tonne mixer type hot metal car.

The height of the cover was 350 mm and the short and long axes of the largest oval in FIG. 5*a* were 900 and 1300 mm respectively.

The cover consisted of a cardboard skeleton 33, lined with a plate-form material 35, 30 mm thick. The skeleton was provided with handles 34.

The material of the plates was in two versions and consisted of:

Version I

25–33% refractory fibrous material
50–66% fireclay
4–8% binding agent

Version II

10–20% refractory fibrous material
60–80% sand
5–10% scrap paper
4–8% binding agent
Each cover weighed approx. 40 kg.

In a first test a cover was fitted on an empty mixer car and the temperature in the mixer car was measured. The measured temperature gradient was compared with data on the cooling behaviour of an empty mixer without a cover. The results of this test can be summarised by stating that cooling of the mixer car over the temperature range from 1200° to 800° C. takes place in 12.8 hours when a cover is used. The comparative value, without the use of a cover, is 7.3 hours. This shows that a considerable proportion of the heat loss takes place through the opening. The refractory quality of the cover appeared to be adequate in this test.

In a second test cover was fitted on an empty mixer car and the mixer car was then filled with pig iron. On commencing filling a hole was easily made in the cover. When the hole was formed there was no splashing of the pig iron jet. After filling the cover had completely disappeared. No parts of the cover could be found in the pig iron bath.

In a third test a cover was fitted on a full mixer car and the pig iron was transferred from the mixer car into a pig iron pit. In this case the cover was easily carried away by the pig iron without disturbing the pig iron jet, i.e. the direction of the jet was not disturbed by the cover. The entire cover was carried away. No remains of the cover were found.

While this invention has been illustrated by various preferred embodiments, it is not limited to those embodiments and extends to all methods and structures within the spirit and scope of the invention as herein described and as claimed in the following claims.

What is claimed is:

1. A method of operating a transfer vessel for the transport of molten iron comprising the steps of (a) filling said vessel with molten iron at a charging location at a blast furnace through an opening in said vessel (b) closing said opening by means of a disposable cover, (c) moving said vessel to a discharge location at a steel making plant, (d) treating the iron in the vessel during the journey from the blast furnace to the steel making plant by the use of a lance which is inserted into the vessel through a hole in the said cover, discharging the molten iron from the vessel in a manner such that at least part of said disposable cover is carried away by the discharging molten iron and is thus lost into the molten iron, (f) closing the opening of the vessel by means of a further disposable cover, (g) moving the vessel to a charging location at a blast furnace, and (h) charging molten iron into the vessel in a manner such that at least part of said further disposable cover is carried away by the charging molten iron and is thus lost into the molten iron.

2. A method aecording to claim 1 in which the said hole is made by perforating the cover by means of the lance.

3. A method of operating a transfer vessel for the transport of molten iron comprising the steps of (a) filling said vessel with molten iron at a charging location at a blast furnace through an opening in said vessel;

(b) closing said opening by means of a disposable cover;

(c) perforating the cover to permit treatment of said molten metal;

(d) making at least one further hole in said cover to permit egress of gas from the vessel during treatment;

(e) treating the molten iron in the vessel by means of a lance inserted into the vessel through the perforation in said cover;

(f) moving said vessel during said treatment to a discharge location at a steel making plant;

(g) discharging the molten iron from the vessel in a manner such that at least part of said disposable cover is carried away by the discharging molten iron and is thus lost into the molten iron;

(h) closing the opening of the vessel by means of a further disposable cover;

(i) moving the vessel to a charging location at a blast furnace; and (j) charging molten iron into the vessel in a manner such that at least part of said further disposable cover is carried away by the charging molten iron and is thus lost into the molten iron.

4. The method according to claim 3 wherein the perforation in the cover is made by a lance.

5. A device for operating a mixer type hot metal car, the car comprising a vessel for the transport of molten iron having an opening through which it is filled and emptied, a disposable cover suitable to close the opening of said vessel and means for retaining the cover in place at the opening, said cover having a region of reduced strength which is over a part of the opening in use, which region of reduced strength can be perforated by pressure applied to it from the outside of the cover, said region of reduced strength being a shear plate fixed to the top of an orificed cover.

6. A device for operating a mixer type hot metal car, the car comprising a vessel for the transport of molten iron having an opening through which it is filled and emptied, a disposable cover suitable to close the opening of said vessel and means for retaining the cover in place at the opening, said cover having a region of reduced strength which is over a part of the opening in use, which region of reduced strength can be perforated by pressure applied to it from the outside of the cover, said region of reduced strength being a cap fitting within an orifice of the cover.

* * * * *